US008929573B2

(12) United States Patent
Ruwe et al.

(10) Patent No.: US 8,929,573 B2
(45) Date of Patent: Jan. 6, 2015

(54) POWERED HEADSET ACCESSORY DEVICES

(75) Inventors: Matthew Neil Ruwe, Hopedale, MA (US); Daniel D. Gonsalves, Hudson, NH (US)

(73) Assignee: Bose Corporation, Framingham, MA (US)

( * ) Notice: Subject to any disclaimer, the term of this patent is extended or adjusted under 35 U.S.C. 154(b) by 348 days.

(21) Appl. No.: 13/617,254

(22) Filed: Sep. 14, 2012

(65) Prior Publication Data

US 2014/0079257 A1 Mar. 20, 2014

(51) Int. Cl.

| | |
|---|---|
| ***H04R 1/10*** | (2006.01) |
| ***H04R 5/02*** | (2006.01) |
| ***F21V 21/084*** | (2006.01) |
| ***H01H 19/02*** | (2006.01) |

(52) U.S. Cl.
USPC ..... 381/309; 381/74; 362/105; 200/316

(58) Field of Classification Search
CPC ..... F21V 23/0428; H01H 19/025
USPC ..... 362/649, 105, 253; 200/316, 565, 567
See application file for complete search history.

(56) References Cited

U.S. PATENT DOCUMENTS

| | | | | |
|---|---|---|---|---|
| 4,969,069 | A * | 11/1990 | Eichost | 362/105 |
| 5,353,205 | A | 10/1994 | Hudak | |
| 5,647,016 | A | 7/1997 | Takeyama | |
| 5,894,113 | A * | 4/1999 | Wingate | 181/141 |
| 5,951,141 | A * | 9/1999 | Bradley | 362/105 |
| 6,097,315 | A | 8/2000 | Minter | |
| 6,873,862 | B2 | 3/2005 | Reshefsky | |
| 6,918,678 | B2 * | 7/2005 | McClanahan | 362/105 |
| 2002/0027777 | A1 | 3/2002 | Takasu | |
| 2003/0022703 | A1 | 1/2003 | Reshefsky | |
| 2006/0013410 | A1 | 1/2006 | Wurtz | |
| 2006/0159279 | A1 | 7/2006 | Kuo et al. | |
| 2007/0230709 | A1 | 10/2007 | Wedge | |
| 2008/0137896 | A1 | 6/2008 | Tsen | |
| 2009/0323975 | A1 | 12/2009 | Groesch | |
| 2010/0260361 | A1 | 10/2010 | Yamkovoy | |

FOREIGN PATENT DOCUMENTS

| | | | |
|---|---|---|---|
| EP | 2242287 | A1 | 10/2010 |
| WO | 9913682 | A2 | 3/1999 |
| WO | 2007035020 | A1 | 3/2007 |

OTHER PUBLICATIONS

EP Extended Search Report dated Aug. 11, 2010 for EP Appln. No. 10159120.4.
International Search Report and Written Opinion dated May 20, 2014 for International application No. PCT/US2013/059167.
Invitation to Pay Additional Fees dated Jan. 9, 2014 for International application No. PCT/US2013/059167.

* cited by examiner

*Primary Examiner* — Thang Tran
*Assistant Examiner* — Mark Fischer

(57) ABSTRACT

A device for coupling to a connector on an ear cup of a headset includes a mating connector corresponding to the connector of the headset. The mating connector includes a crossover conductor coupled to a first and a second terminal within the mating connector. One or more accessory circuits is provided by the device, including a lamp configured to direct light onto a surface external to the device or a position detection circuit usable to adjust three-dimensional audio signals to account for the direction the user is looking.

5 Claims, 12 Drawing Sheets

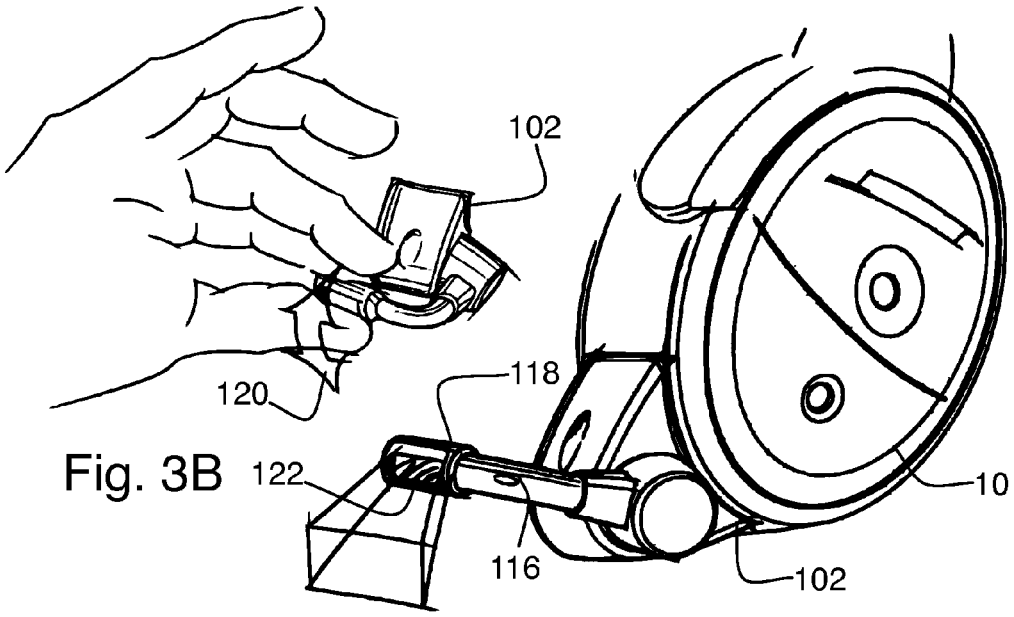
Fig. 3B
Fig. 3A
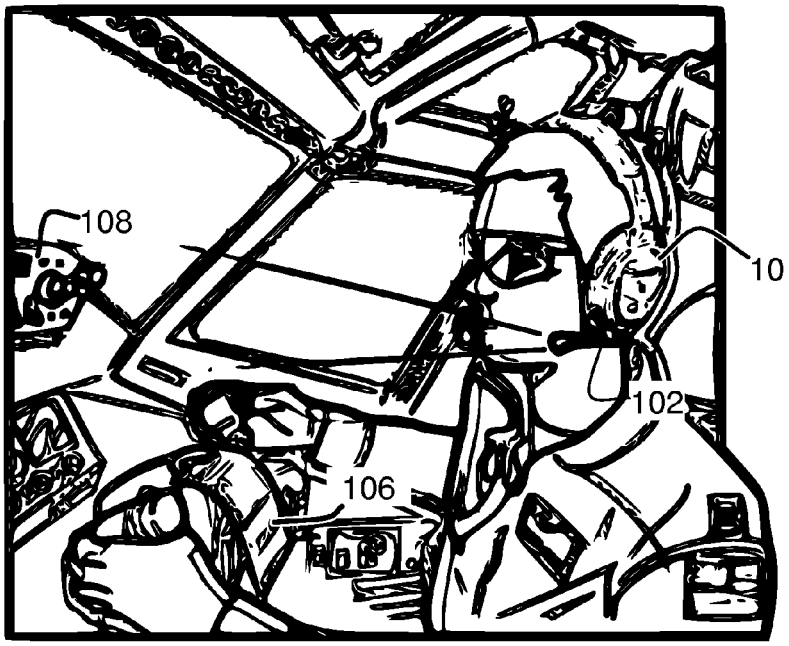
Fig. 3C

POWERED HEADSET ACCESSORY DEVICES

BACKGROUND

This disclosure relates to providing powered accessory devices for headsets.

U.S. Patent Publication 2010/0260361, fully incorporated herein by reference, describes a headset with a modular connection allowing a down-cable, optionally supporting a boom microphone, to be connected to either ear cup, with a crossover plug connected to the opposite ear cup to connect an audio signal provided by the down-cable to the acoustic driver in the ear cup to which the plug is connected. FIGS. 1A and 1B are derived from FIGS. 1 and 4 of that publication. As shown in FIG. 1A, the system incorporates a headset assembly 10, a down-cable assembly 20 and a crossover plug 30. The headset assembly 10 incorporates a first ear cup 12*a* having an acoustic driver 14*a* and a connector 16*a* (both seen more clearly in FIG. 1B), a second ear cup 12*b* having an acoustic driver 14*b* and a connector 16*b*, and a headband 18 that couples together the ear cups 12*a* and 12*b*. The down-cable assembly 20 incorporates an electrically conductive cable 22, an upper coupling 24 to couple one end of the conductive cable 22 to either of the connectors 16*a* and 16*b*, a communications microphone 26*a*, a microphone boom 26*b* coupling the microphone 26*a* to the upper coupling 24, and a lower coupling 28 for connecting the other end of the conductive cable 22 to another device (not shown) such as an aircraft communications panel, a mobile phone, or a portable radio. The plug 30 is able to be coupled to either of the connectors 16*a* and 16*b*.

As shown in FIG. 1B, multiple electrical conductors (e.g., electrical cabling or other form of electrical conductors) are carried by the headband 18 to convey electrical signals between the earpieces 12*a* and 12*b*. Power and ground conductors 40 and 42 are connected to corresponding conductors 50 and 52 in the upper coupling 24 of the down-cable 20 via terminals 60*a* and 62*a* in the connector 16*a*. The power and ground conductors 40 and 42 are also connected to power and ground terminals 60*b* and 62*b* in the second ear cup 12*b* so that the down-cable 20 can be connected to that ear cup instead and still provide power to the headset. The power and ground conductors 40 and 42 provide power to first power electronics 64*a* in the first ear cup 12*a* and second power electronics 64*b* in the second ear cup 12*b*. A crossover conductor 44 is connected to crossover terminals 66*a* and 66*b* in corresponding ear cup connectors 16*a* and 16*b*, but is not electrically coupled to anything else within either ear cup. The connectors 16*a* and 16*b* have left and right audio signal terminals 68*a* and 68*b*, respectively, coupled to the acoustic transducers 14*a* and 14*b*.

In the example of FIG. 1B, a crossover conductor 46 in the crossover plug 30 connects the crossover terminal 66*b* to the right audio signal terminal 68*b* in connector 16*b*. In the upper coupling 24 of the down-cable 20, a left audio conductor 54 is coupled to the left audio signal terminal 68*a* in the connector 16*a*, while a right audio conductor 56 is connected to the crossover terminal 66*a*, from which the crossover conductor 44 conducts the right audio signal to the crossover terminal 66*b* in the connector 16*b*. In this way, the crossover conductor 46 couples the right audio from the crossover terminal 66*b* to the right audio terminal 68*b*. If the down-cable 20 and crossover plug 30 were reversed, the right audio conductor 56 would be connected directly to the right audio terminal 68*b* to deliver audio signals to the right transducer 14*b* (via the power electronics 64*b*), while the crossover conductors 44 and 46 would couple the left audio signals from the to the left audio conductor 54 to the left audio terminal 68*a* through the crossover terminals 60*a* and 60*b*. This allows the down-cable 20 to be connected to either ear cup, without having to provide both left and right signals across the headband, and without any need to detect which side the down cable is connected to.

The design described in publication 2010/0260361 is implemented commercially in the A20® Aviation Headset from Bose® Corporation of Framingham, Mass.

SUMMARY

In general, in one aspect, a device for coupling to a connector on an ear cup of a headset includes a mating connector corresponding to the connector of the headset, the mating connector including a crossover conductor coupled to a first and a second terminal within the mating connector, and a lamp configured to direct light onto a surface external to the device.

Implementations may include one or more of the following. A power conductor and a ground conductor may couple power and ground terminals of the lamp to third and fourth terminals in the mating connector. A battery compartment may have positive and negative terminals for coupling to a battery, and a power conductor and a ground conductor coupling power and ground terminals of the lamp to the positive and negative battery terminals. A second power conductor and a second ground conductor may couple the positive and negative battery terminals of the lamp to third and fourth terminals in the mating connector. A body may house the mating connector, with a boom extending from the body including a first aperture through which light from the lamp may exit the boom and a cover, rotatable around the boom and having a second aperture, blocks the first aperture when the cover in a first rotation position and aligns the second aperture with the first aperture when the cover in a second rotation position, and a switch is electrically coupled to the lamp and mechanically coupled to the cover, such that rotating the cover between the first and second rotation positions activates the switch to turn the lamp on when the cover is in the second rotation position and off when the cover is in the first rotation position.

In general, in one aspect, a device for coupling to a connector on an ear cup of a headset includes a mating connector corresponding to the connector of the headset, the mating connector including a crossover conductor coupled to a first and a second terminal within the mating connector, a position sensor for determining a position of the device, and a data connection outputting data from the position sensor.

Implementations may include one or more of the following. A second position sensor may determine a position of the device on a second axis, orthogonal to a first axis on which the first position sensor determines position. The first and second position sensors may include gyroscopes responsive to rotation around the respective first and second axes. The first and second position sensors may include accelerometers responsive to displacement along the respective first and second axes. The first and second position sensors may include magnetometers responsive to changes in magnetic fields associated with movement of the device around the respective first and second axes.

In general, in one aspect, a system for providing directional audible information to a user includes a headset having a first ear cup having a first connector and a second ear cup having a second connector, both of the first and the second connectors being operable for connection to an aircraft radio. An acoustic imaging system is operable to receive a sound signal and first data identifying a first directional location, relative to a first external reference, associated with the sound, receive second data identifying a direction the user may be looking relative to a second external reference, generate binaural audio signals that represent the sound at a second directional location when perceived by the user, the second directional location corresponding to the first directional location and adjusted according to the direction the user may be looking, such that the user perceives the direction of the source of the sound to be at the first directional location relative to the first external reference, and output the binaural audio signals. An accessory device for coupling to either of the first or the second connector of the headset includes a mating connector corresponding to the connectors of the headset, the mating connector including a crossover conductor coupled to a first and a second terminal within the mating connector, a position sensor for determining a position of the accessory device, and a data connection outputting data from the position sensor to the acoustic imaging system. The data from the position sensor includes the second data representative of the direction the user may be looking relative to the external reference.

Implementations may include one or more of the following. The acoustic imaging system may be coupled to the aircraft radio, and the system may be configured to mix the binaural audio signals output by the acoustic imaging system with communications audio signals from the radio and deliver the mixed signals to the headset. The binaural audio signals output by the acoustic imaging system may be provided to the headset independently of signals from the aircraft radio. The accessory device may include a second data connection receiving the binaural audio signals from the acoustic imaging system and an audio output for providing the binaural audio signals to the headset through the mating connector. The accessory device may include a wireless transmitter for communication with the acoustic imaging system, and the acoustic imaging system may include a wireless receiver for communication with the accessory device. The first and second data may include two-dimensional location data. The two-dimensional location data may a horizontal angle away from a vertical origin of the first or second external reference, and a vertical angle away from a horizontal angle of the first or second external reference. The first external reference may be the Earth, the vertical origin of the first external reference may be a line parallel to gravity and ahead of the direction an aircraft may be traveling, and the horizontal origin of the first external reference may be the horizon. The second external reference may be an aircraft in which the user is located, the vertical origin of the second external reference may be a line directly in front of the aircraft and vertical when the aircraft is level, and the horizontal origin of the second external reference may be in a plane intersecting the user's ears and perpendicular to gravity when the aircraft is level.

In general, in one aspect, a device for coupling to a connector on an ear cup of a headset includes a mating connector corresponding to the connector of the headset, the mating connector including a crossover conductor coupled to a first and a second terminal within the mating connector, and a wireless transceiver coupled to a third and a fourth terminal within the mating conductor.

In general, in one aspect, a device for coupling to a connector on an ear cup of a headset includes a mating connector corresponding to the connector of the headset, the mating connector including a crossover conductor coupled to a first and a second terminal within the mating connector, and a portable power supply coupled to a third and a fourth terminal within the mating conductor.

Advantages include the ability to provide modular accessories to a headset without requiring cumbersome attachment mechanisms. Power may be provided from the headset to the accessory, from the accessory to the headset, or shared between them.

Other features and advantages will be apparent from the description and the claims.

BRIEF DESCRIPTION OF THE DRAWINGS

FIGS. 3A, 3B, and 3C show an example of a modular accessory for use with a headset like that of FIG. 1A.

DESCRIPTION

Figure 1A:
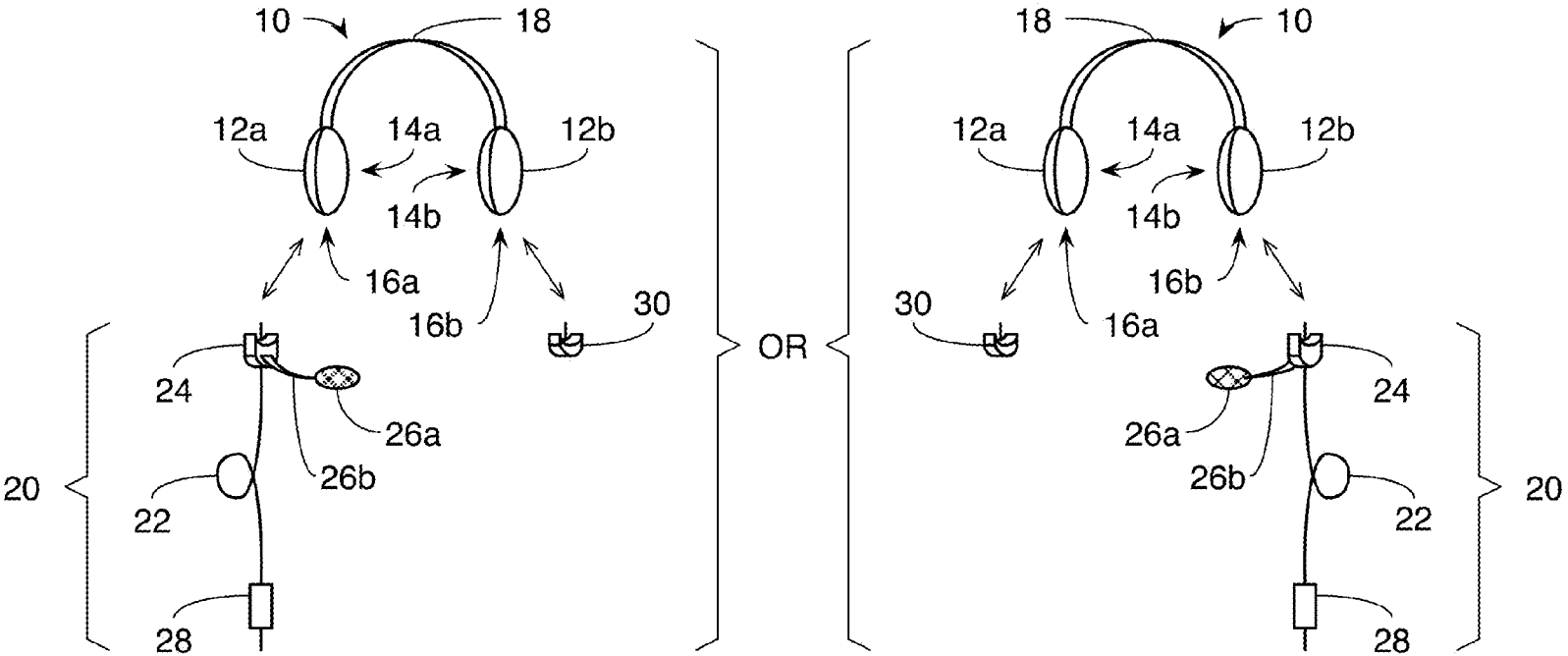
FIG. 1A (prior art)
FIG. 1A shows a headset with a cable and terminator that can be attached to either ear cup.
Figure 1B:
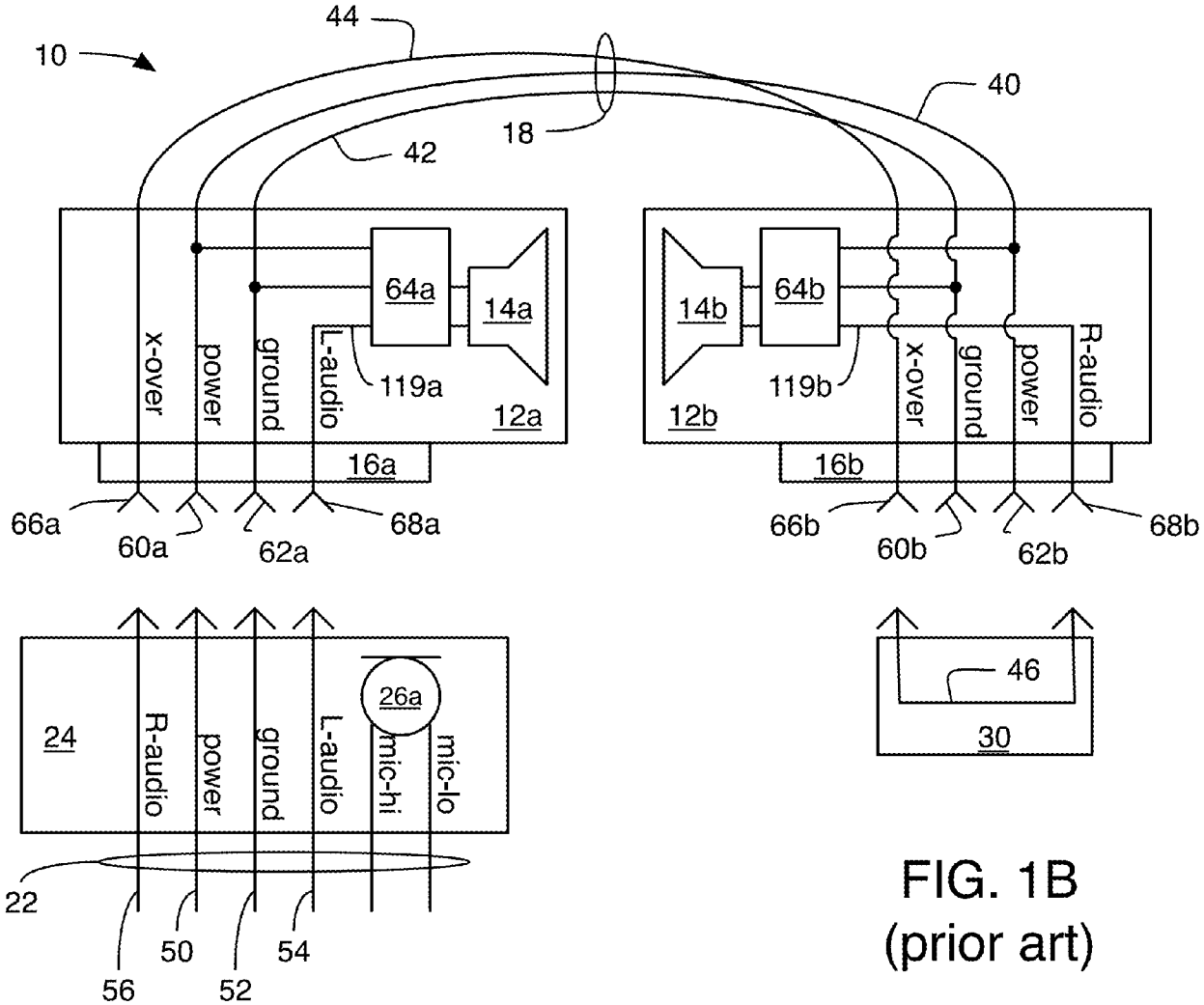
FIG. 1B (prior art)
FIG. 1B shows a schematic diagram of example wiring for the headset of FIG. 1A.
Figure 2:
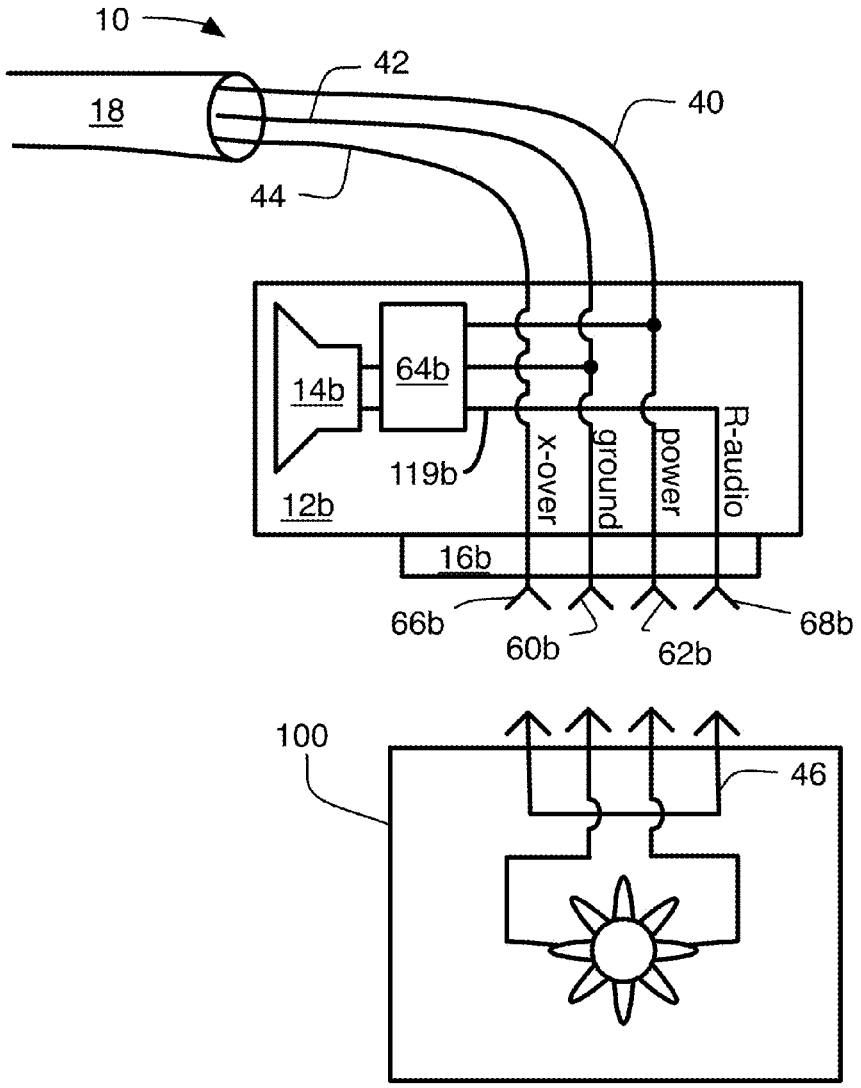
FIGS. 2, 4, 5, 6, 7, 8, 9, 10, and 11 show schematic diagrams of modular accessories and their connection to a headset like that of FIG. 1A.
Figure 4:
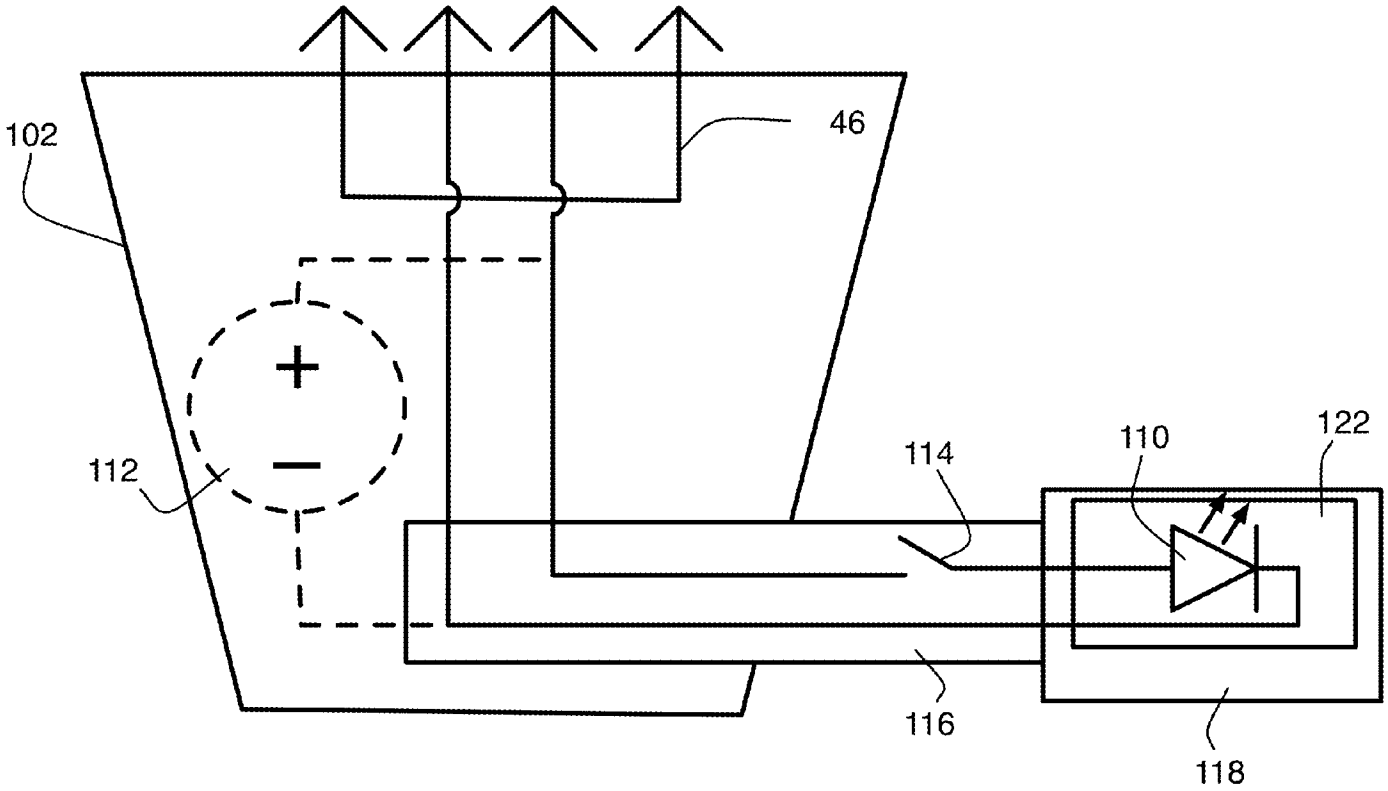

Additional capabilities may be added to a headset through the use of modular accessories that connect in place of the crossover plug described above. In FIG. 1B, note that power and ground conductors 40 and 42 are connected to corresponding terminals 60*a*, 60*b*, 62*a*, and 62*b* in each ear cup, but are not used by the crossover plug 30. As shown in FIG. 2, a modular accessory 100 connected in place of the crossover plug 30 may use the power available from the power and ground terminals 60*b* and 62*b* (or terminals 60*a* and 62*a* if connected to the first ear cup) for its own operation. Alternatively, the modular accessory 100 may provide power to the headset via those same conductors, in place of, or to supplement, the power provided by the down-cable 20. Several such accessories are described below. In other examples, the power available from the headset is insufficient to power the accessory, which supplies its own power, but is used to confirm for the accessory that the headset is in use. In still other examples, the power from the headset isn't needed by the accessory at all, but the connector 16*a* or 16*b* provides a useful attachment point for the accessory.

One type of accessory for this application is a reading lamp 102, as shown in FIGS. 3A, 3B, 3C, and 4. For aviation headsets, such as the headset 104, pilots or passengers may need to view flight documents, e.g., a chart 106, and instrumentation, e.g., a control panel 108, in dark cockpits. Providing a small lamp 102 connected directly to the headset 10 keeps the light focused on whatever the user is looking at. Using the attachment point provided by the connector 16*a* or 16*b* (FIG. 1B) provides a more elegant and simple solution than other means of attaching a lamp to the headset, such as zip ties, glue, or hook-and-loop fasteners. It also leaves the user with one fewer piece of equipment to keep track of. A LED light source 110 will generally be sufficient, while having a low enough power requirement to either be powered by the headset power or by a small on-board battery 112. In particular, a red LED will help retain the user's dark-adapted vision and may be compatible with military night vision goggle systems.

A switch 114 is included which allows the user to turn the lamp on and off as needed. In some examples, the light source 110 is located at the end of a short boom 116, and the switch 114 is connected to a rotatable section 118 at the end of the boom. Turning the rotatable section 118 (arrow 120 in FIG. 3B) turns the lamp 102 on and off. In some examples, the light source 110 may be part of the rotatable section 118 and rotate with it, or it may be located within the rotatable section and exposed or concealed by an aperture such as a window 122 in the rotatable section 118. The act of rotating the section 118 then serves to expose or conceal the light source 110, along with activating the switch 114 to turn it on when exposed and off when concealed. This provides a more intuitive interface to the user than a traditional push-button or toggle switch, in which the operation of the switch has no natural relationship to the state of the lamp.

Figure 5:
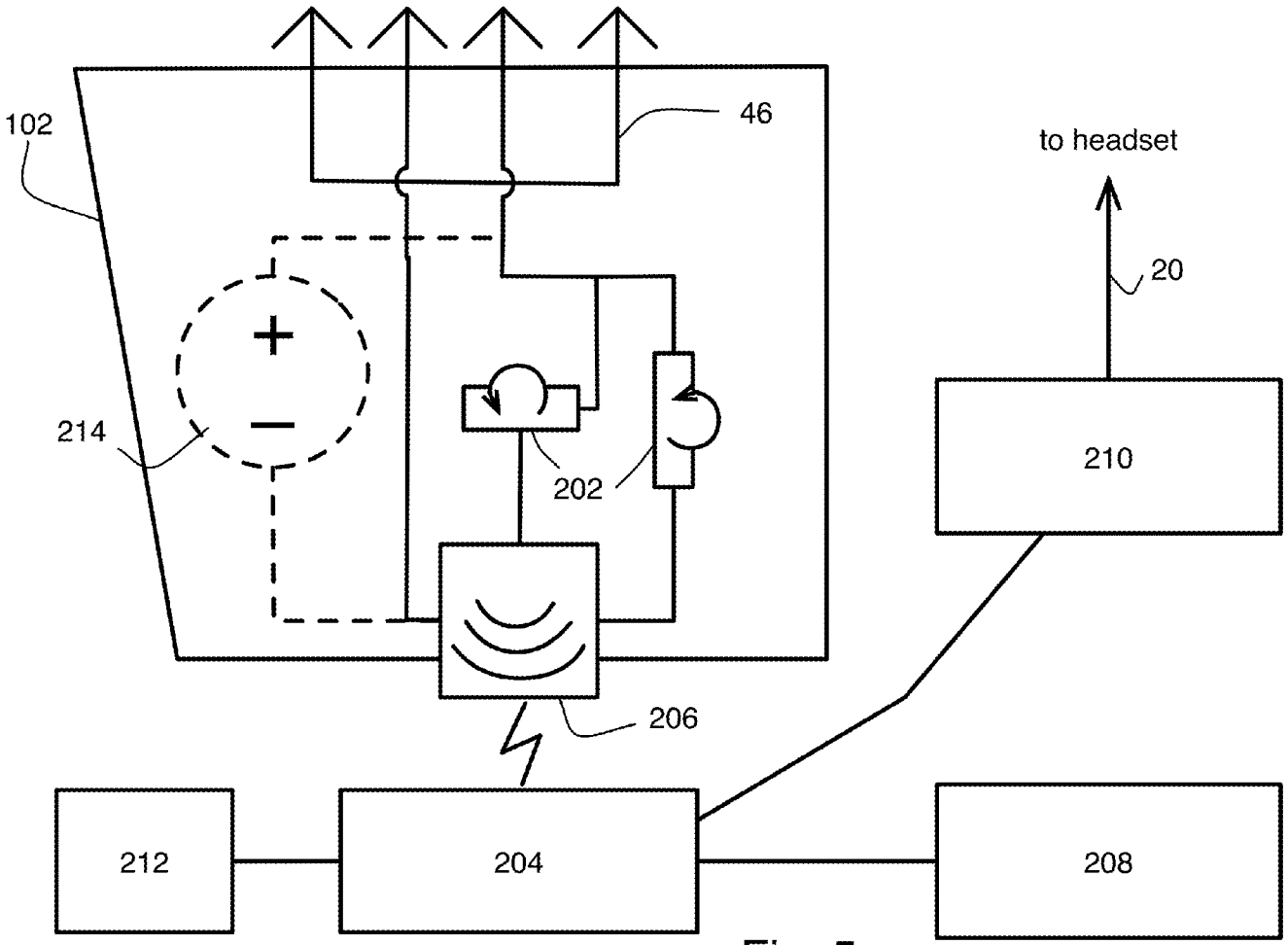

Another type of accessory that may be coupled to the headset 10 through the connector 16*a* or 16*b* is a head-tracking sensor module. As shown in FIG. 5, a head tracking sensor module 200 includes sensors 202, such as gyroscopes, accelerometers, or magnetic field sensors, that measure the one-, two-, or three-dimensional angle of the headset, from which the direction the user is looking may be inferred. In a one-dimensional example, the rotation of the user's head in a horizontal plane is measured, i.e., how far left or right the user is looking. A second dimension would typically be elevation from the horizontal plane, i.e., how far up or down from the horizon the user is looking. In some examples, a third dimension, the side-to-side tilt of the user's head could also be measured. The sensor data is provided to an external processing system 204 through a data connection, such as a wireless link 206.

This information can then be used by two- or three-dimensional acoustic imaging systems to modify the sounds sent to the headset 10 to that the intended two- or three-dimensional position of a sound, relative to the vehicle, is adjusted to compensate for the actual direction the user is facing. For example, if an audible warning indicating the presence of another aircraft is meant to be positioned at 45 degrees to the right, relative to the aircraft's heading (the direction the aircraft is pointing), but the pilot is already looking 30 degrees to the right, then the sound should be delivered to the headset so that the pilot perceives it to be 15 degrees farther to the right of where he is facing. Vertical information, if present in the audio system and measured by the sensor module 200, can be similarly compensated. In some examples, vertical distance is provided as the relative elevation distance between the two aircraft. This may be combined with the lateral distance between them (absolute or projected into a horizontal plane, such as the ground) to compute the angle up or down at which the other aircraft can be observed.

In the example of FIG. 5, the external processing system 204 is connected to the aircraft's warning system 208 and radio 210. The processing system 204 receives the audio signals and intended position data from the warning system 208 and the actual head position information from the sensor module 200 (plus any available information about the aircraft's heading, such as from a GPS system 212), and modifies the audio signals based on the transfer function of the headset 10 so that the sounds will be heard from the correct location. It then provides the modified audio signals to the radio 210 for delivery to the headset.

Alternatively, the headset 10 may be directly connected to the external processing system 204 through its down-cable 20, such that the audio from the radio 210 is mixed with the modified directional audio signals within the external processing system 204 and delivered to the headset 10 by the processing system 204. In this embodiment, the wireless link 206 may be omitted, as the data from the sensors 202 can be delivered to the processing system 204 via the down-cable 20, for example by modulating it onto the power line 40 in the headset.

In some examples, directional information for warning sounds is delivered to an aircraft based on the direction the aircraft is moving (its "ground track"), which may not match the aircraft's actual heading (i.e., due to crosswinds adding a sideways component to the aircraft's movement), let alone the direction the pilot is facing within the aircraft. In such a situation, the audio system may compensate for both the aircraft's real heading relative to its ground track as well as the pilot's head position relative to the aircraft heading.

Similar systems may be used on ground vehicles, such as to warn a driver about nearby vehicles or to inform a gunner of the direction of a target, and on ships for similar purposes, when the available directional information is based on the heading of the vehicle or weapons platform, but the user may be looking another direction. A further example is use by a dismounted soldier, who may have a sniper-detection or other combat information system located in a backpack or otherwise on his body that produces audible indications of the direction of threats or squad mates. Adjusting audio warnings based on the direction the soldier is looking relative to the position of the detection system allows him to immediately know which direction the threat is located in. Similarly, if the relative position of other soldiers communicating over a radio is known, their voices can be delivered to the soldier's headset in the correct spatial position, helping maintain situational awareness. In a civilian context, such a system may be used to help a crane operator keep track audibly of the direction of a spotter communicating from the ground, to name one example.

As with the lighting example, using the connector on the headset minimizes the amount of equipment the user must have attached to his head or helmet, while allowing the headset itself to remain relatively simple, that is, the sensors and related circuitry do not need to be integrated into the headset. If power available to the headset, such as from a vehicle intercom to which it is attached, is sufficient to power the sensor system, then the power and ground lines 40 and 42 may be used. If that power is not sufficient, or not always available, as in the case of a dismounted soldier using a portable radio, then an on-board battery 214 within the sensor module 200 may provide the required power.

Additional accessories that may make use of a connection socket on a headset are shown in FIGS. 6 through 11. In these figures, we refer to the ear cup 12, connector 16, and components including driver 14, ANR circuit 64, audio conductor 119, and terminals 60, 62, 66, and 68 generically, without specifying the right or left ear cup. Some figures also show additional signal terminals between the headset and the accessory—while minimizing changes to the headset provides the advantages discussed above, additional accessory features may be enabled by increasing the connectivity between the accessory and the headset, such as providing a data channel between processors located in each. In some examples, the audio and other signals between the headsets may be digitized and multiplexed, allowing the number of wires in the headband to be kept low.

Figure 6:
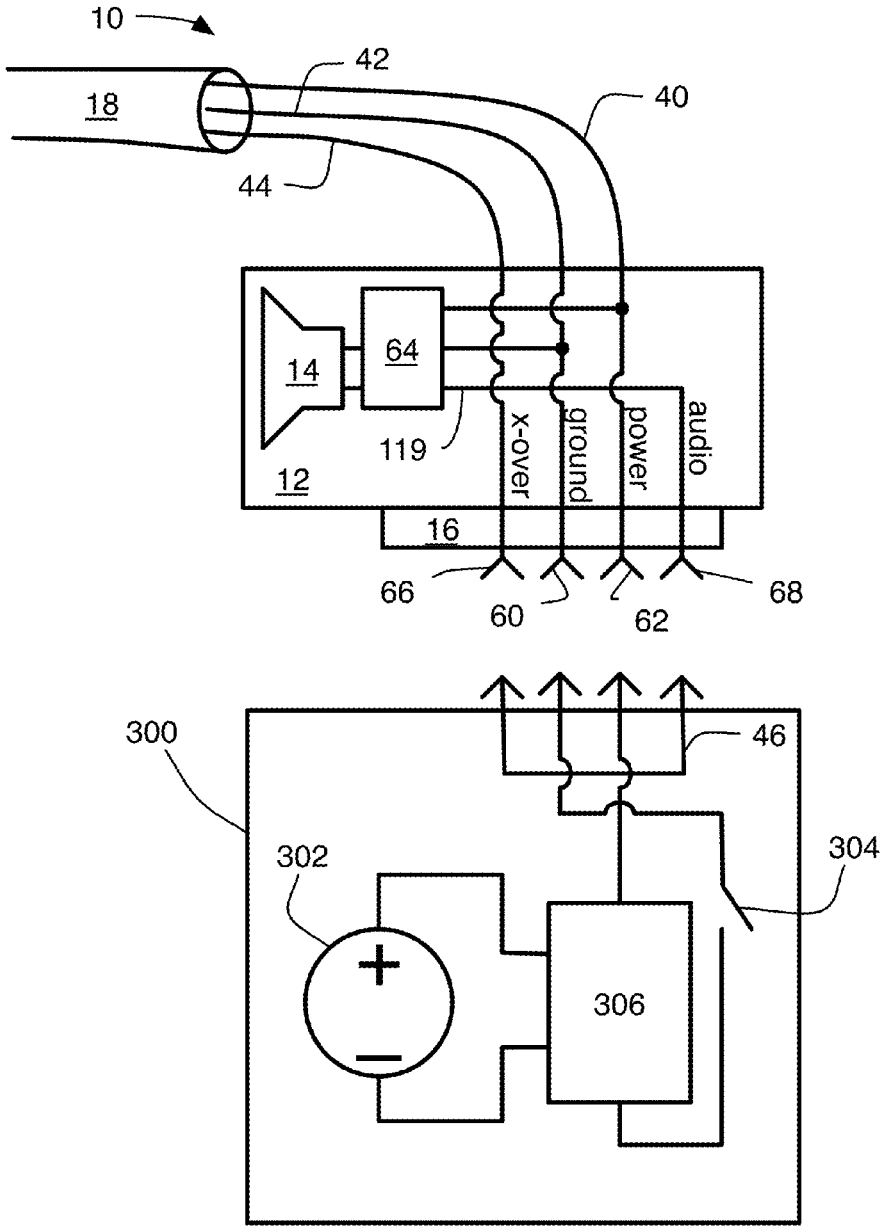

In FIG. 6, an accessory 300 includes a battery circuit 302 coupled to the power and ground terminals, and optionally a power switch 304 to control whether power is provided or a power supply circuit 306 to control the flow of voltage and current between the battery and the headset. Such a battery circuit may be combined with any of the other accessories discussed here, or may be the entire purpose of the accessory device. Additional features may include a charge indicator light 308, and external charging contacts or plug 310 for recharging the battery. An accessory with such a battery circuit may be used with a variety of other accessories by plugging the accessory with the battery circuit 302 into one ear cup and the other accessory into the other. The battery accessory may also be used on its own to power the ANR circuits of a headset that doesn't otherwise need to be plugged in. In some examples, two accessories with batteries may be used, one attached to each ear cup, to further extend the time in which the headset can be operated. When the headset is plugged into a power supply through the down cable, the power supply circuit 306 may use that power to recharge the battery circuit 302.

Figure 7:
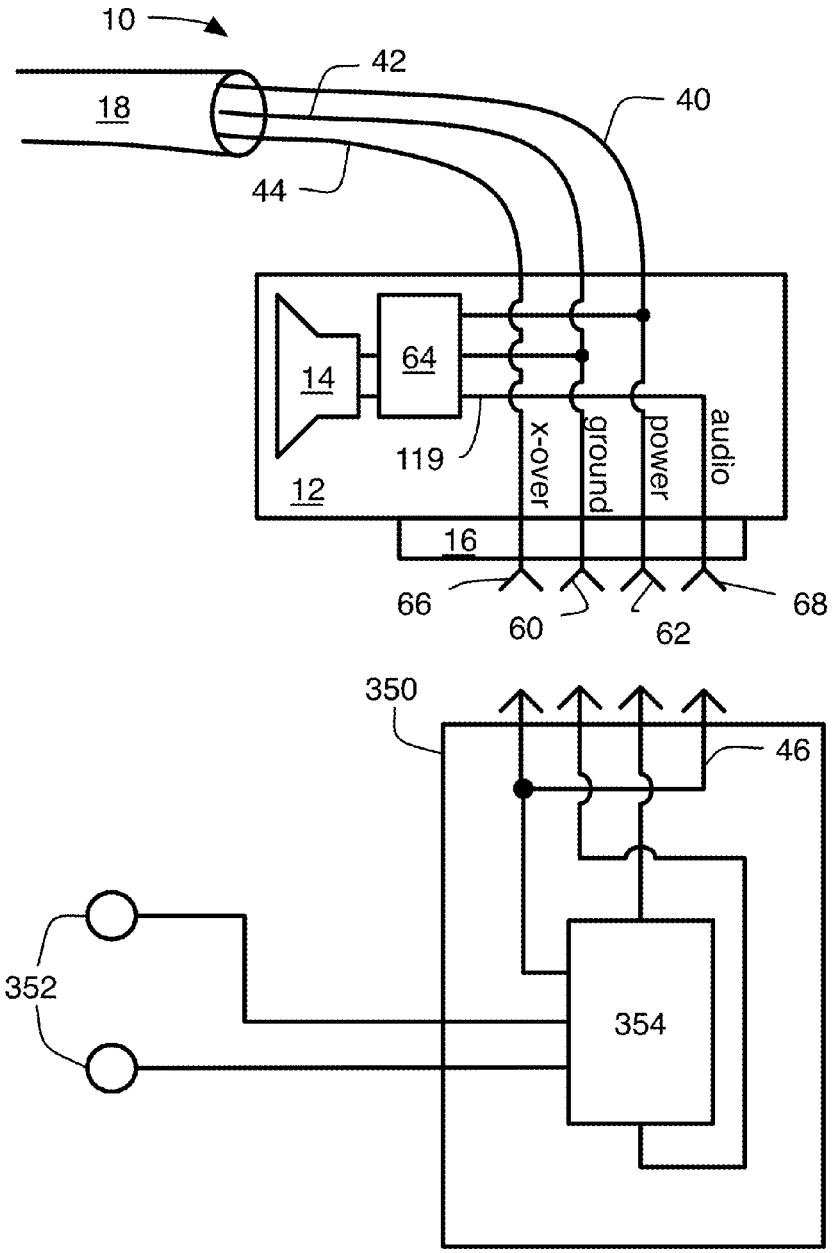

In FIG. 7, a biometric monitoring accessory 350 includes biometric or environmental sensors 352 that measure, for example, blood or atmospheric oxygen levels and heart rate of the user. When a processor 354 determines that the sensor data indicates a problem, such as hypoxia or CO poisoning, it injects a warning signal into the crossover conductor 46, causing the warning to be output by the acoustic driver 14 of the ear cup 12 the monitoring accessory 350 is coupled to. Atmospheric sensors may also be used to derive air pressure in the environment of the headset (i.e., in a cockpit), and adjust performance of the headset, such as by compensating noise cancellation filters based on the speed of sound in the actual cockpit pressure environment. The accessory 350 may make such adjustments itself, if it has appropriate connections to the headset electronics, or it may simply communicate the available data to another controller.

Figure 8:
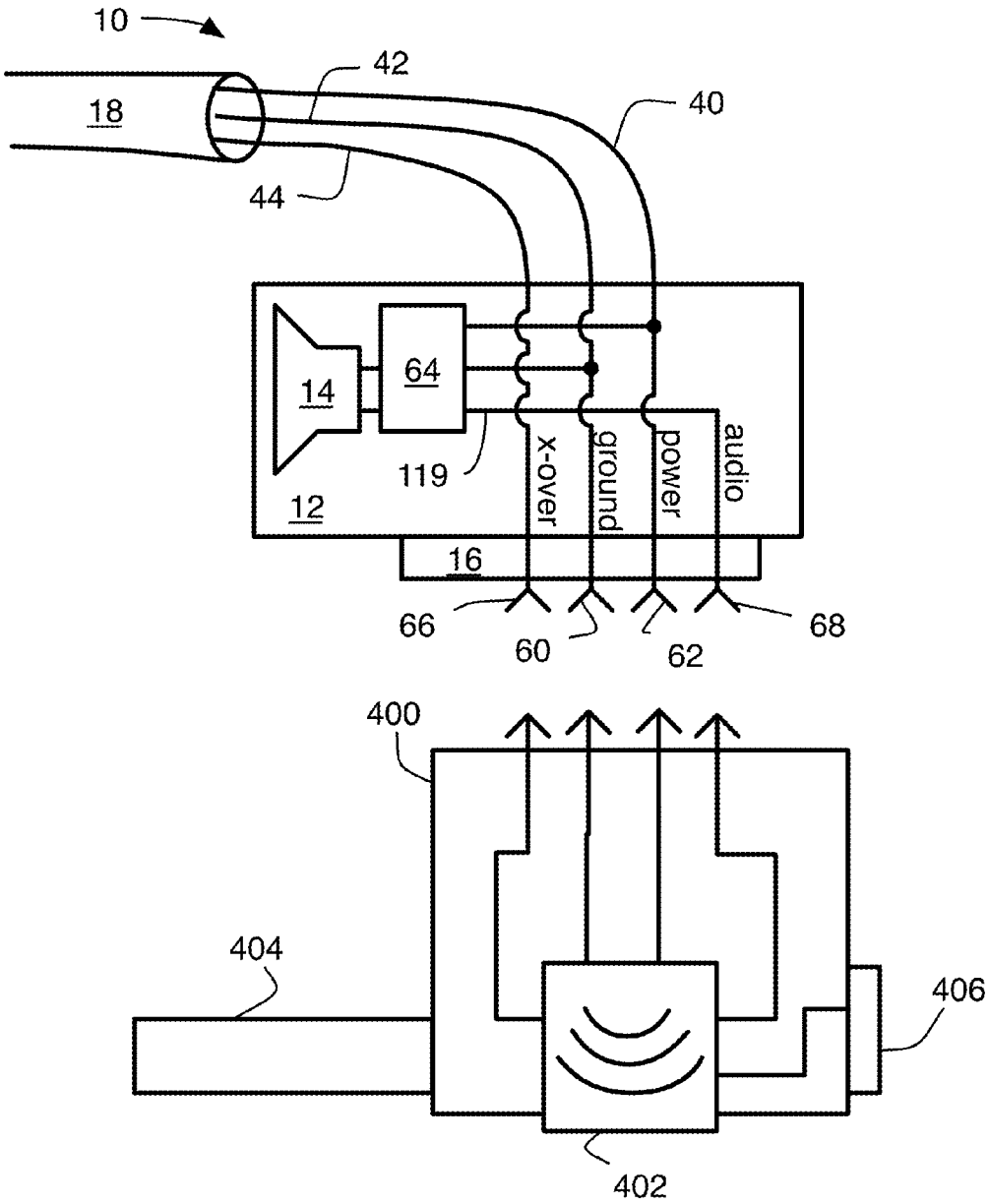

In some applications, a number of headsets are connected to an aircraft intercom, so that the passengers can communicate with the pilot. In FIG. 8, a wireless communication accessory 400 includes a short-range two-way radio 402 that allows the passengers' headsets to communicate with each other and the pilot over a local wireless network, avoiding the need to plug into or even provide wired connections to the aircraft intercom at passenger seating positions. In some examples, the radio circuit 402 provides audio output at terminals 66 and 68, one for the near-side ear cup and one for the cross-over cable for the far side ear cup; in this example, the usual cross-over plug 30 would be attached to the opposite ear cup. In other examples, additional connections may be provided in the connectors, so that the accessory can provide audio to both ear cups when the normal down-cable assembly 20 is used.

In some examples, the accessory 400 includes a built-in or boom microphone 404. A push-to-talk button 406 allows the user to indicate when they wish to speak to other passengers. In other examples, no microphone is provided, and the user can only listen to conversations on the intercom. The no-microphone version may also be used by the pilot, since the pilot headset already has the boom microphone from the down-cable assembly 20, but in that case an additional cable and terminals are needed in the headset to bring the microphone signal across the headband from the down-cable assembly 20 to the wireless accessory 400 for transmission to other wireless headsets. In some examples, the push-to-talk button is provided even when the boom microphone is not, as it may be used with the boom microphone in the down-cable assembly 20 (not shown). Some intercom systems include a receiver for such a switch, and providing the switch in a module that connects integrally to the headset avoids the need to attach a stand-alone switch to the user's clothing or other equipment. In other examples, the pilot may use the version with a microphone to communicate over the aircraft radio, if it is equipped with a compatible transceiver, in place of the wired down-cable assembly 20. This eliminates the need for the pilot to be tethered to the control panel, though that may not be permitted in some situations.

In some examples, the radio 402 can also communicate with accessories such as mobile phones or portable music players, allowing the passengers to use their aircraft headsets to make phone calls or listen to entertainment audio. The radio 402 may be a general-purpose radio transceiver circuit such as a Bluetooth® or WiFi® transceiver, or it may be a custom circuit. The radio 402 may alternatively or additionally receive broadcast radio signals, such as commercial broadcasts or localized broadcasts, such as may be provided at a car race.

Figure 9:
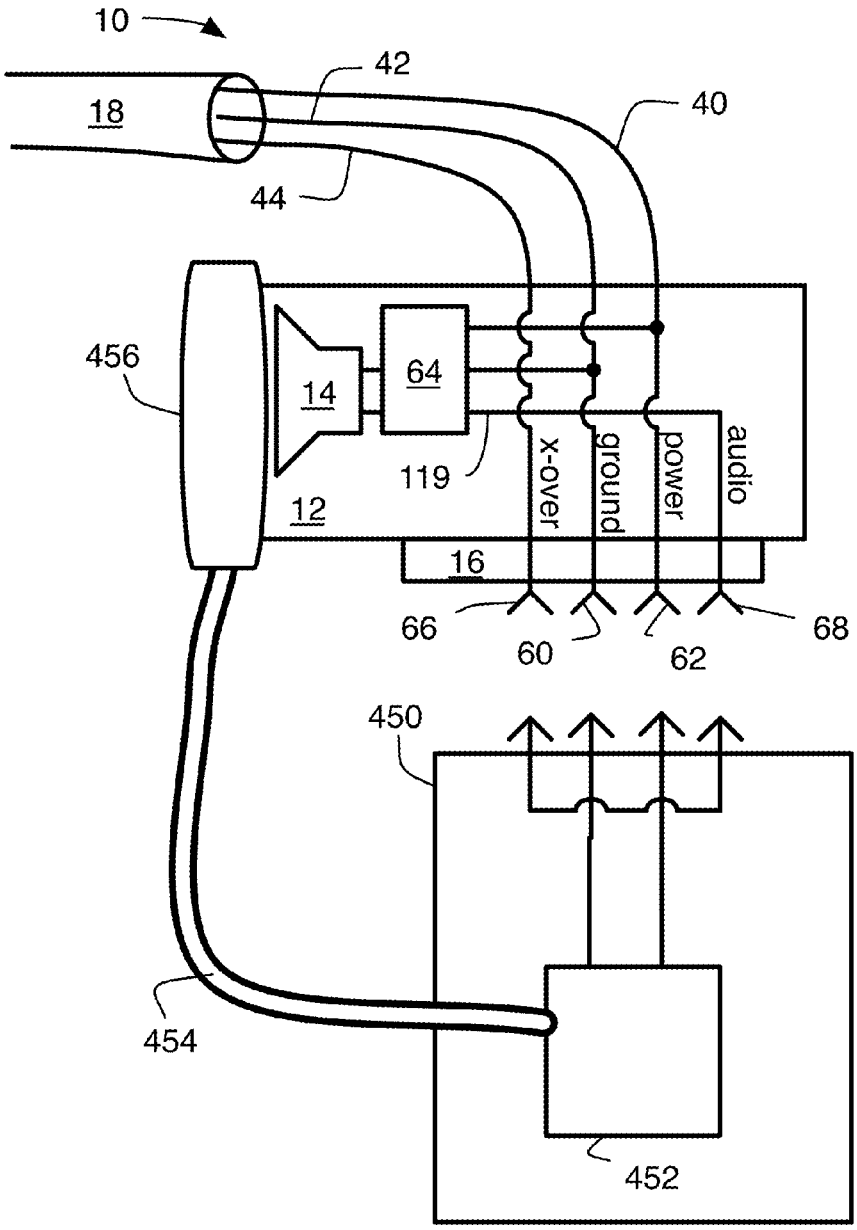

In the example of FIG. 9, an accessory 450 includes a temperature control system 452 which operates to heat or cool the headset by pumping an appropriate fluid through a tube 454 to modified ear cushions 456. This may be useful in applications where the user's head is exposed to undesirable temperature environments, such as where the headset prevents the user from wearing a hat in a cold environment, or where the headset itself is the source of discomfort in a hot environment.

Figure 10:
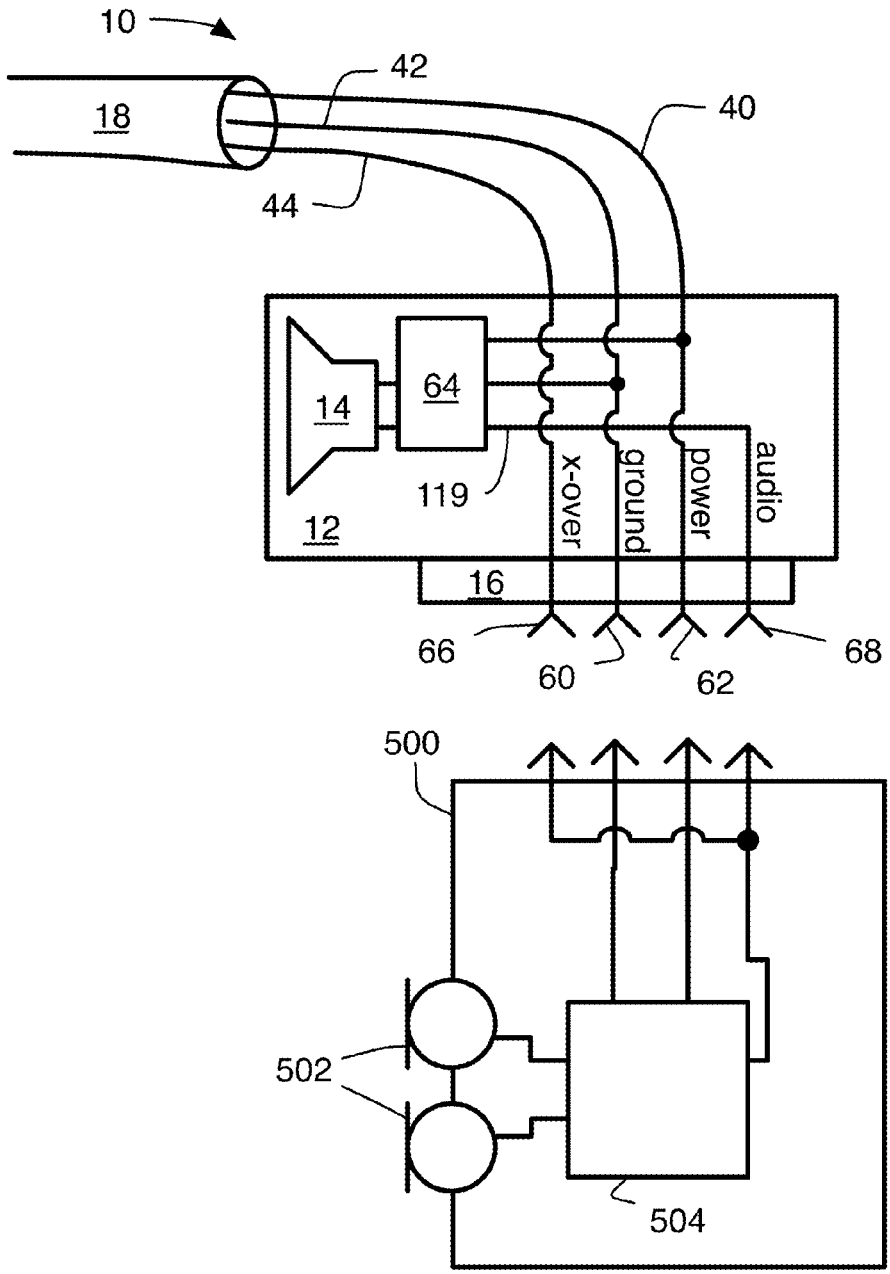

In the example of FIG. 10, an accessory 500 includes a microphone array 502 and array signal processor 504. Such a microphone array provides a talk-through feature, allowing the user to hear the sounds in their environment that would otherwise be blocked by the headset. While the array is shown with two microphones, more may be used in some applications. If paired with a similar microphone array in the other ear cup, or even the boom microphone, the talk-through feature may provide directional awareness to the user.

In some examples, two of the down-cable assembly 20 are used, one for each ear cup. The two assemblies may be slightly different, such as using different connectors for connecting to different types of radio or intercom, or providing different microphone types or bias voltages. One use for such an arrangement is to allow the user to easily connect to both radio types without having to obtain a specialized single down-cable assembly able to connect to both radios.

Figure 11:
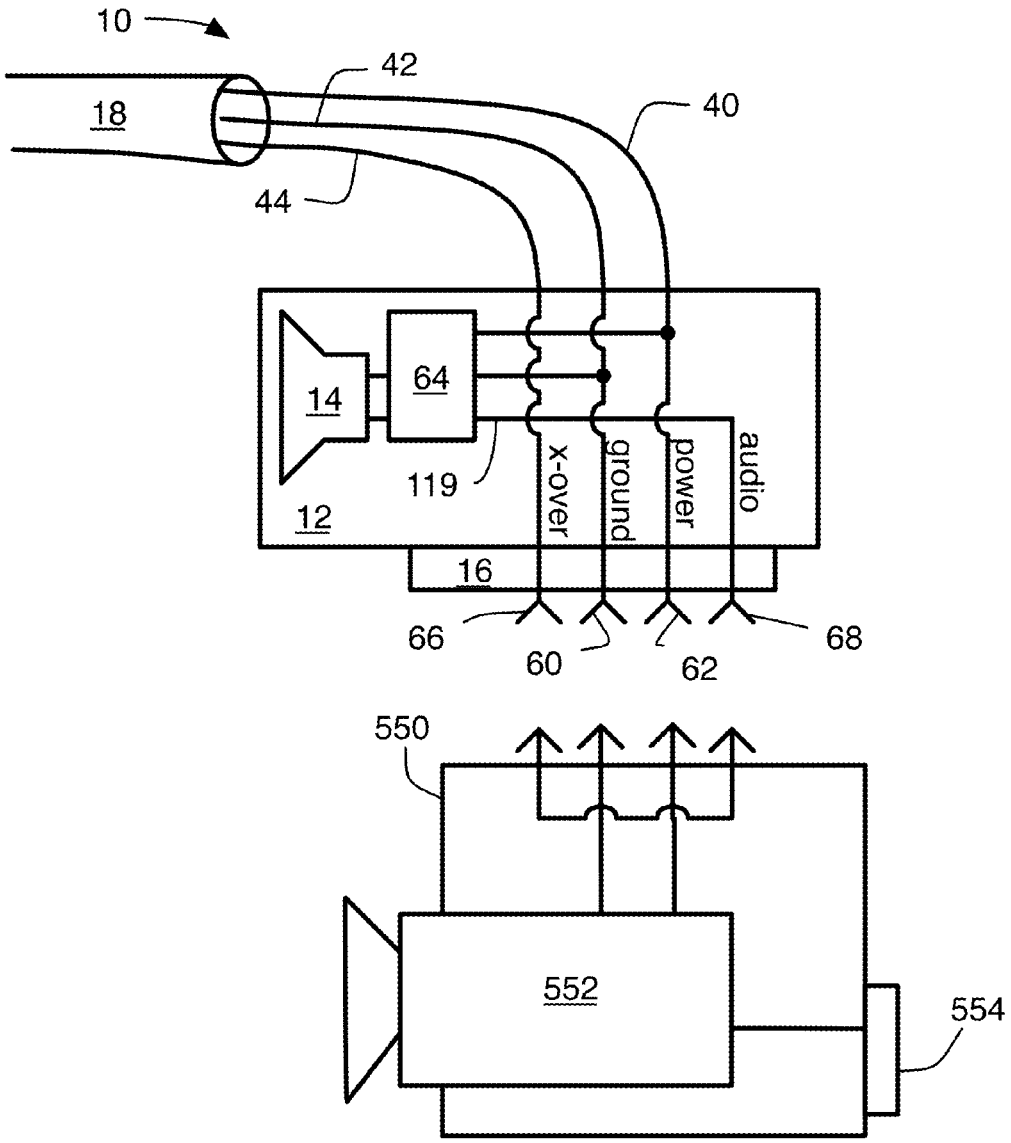

In yet another example, shown in FIG. 11, a camera accessory 550 includes a camera 552. Applications for a headset-mounted camera include recording the pilot's operation of an aircraft as part of the flight record, allowing an instructor to see what a trainee pilot sees (whether live or after a flight), or simply recording the flight from the pilot's point of view for entertainment purposes. The camera accessory may include a trigger switch 554, built-in or wirelessly connected, to allow the pilot or a third party, such as an instructor, to initiate the capture of a still image or start and stop recording. A camera accessory may also be used with or integrated into the head-tracking accessory 204. Head motion data may be used to stabilize the image from the camera, or to map it to specific locations in a display when viewed later. For example, if a recording from the pilot's point of view is to be played back on a flight simulator, the picture should stay in place relative to the simulator, rather than moving around to follow where the pilot was looking.

In various of the above or other applications, two accessory modules may be used which need to communicate with each other. This may be accomplished in several ways, including the provision of additional wires in the headband, running an added wire between the modules separately from the headset, or by providing wireless transceivers, such as those discussed in regard to FIG. 8, in both modules. Any of the various accessories described may be combined with one or more of the others, such as combining the camera accessory with the wireless audio communication accessory or the head tracking with the biometric monitoring.

Other implementations are within the scope of the following claims and other claims to which the applicant may be entitled.

What is claimed is:

1. A device for coupling to a connector on an ear cup of a headset, the device comprising:

a mating connector corresponding to the connector of the headset, the mating connector including a crossover conductor coupled to a first and a second terminal within the mating connector;

a lamp configured to direct light onto a surface external to the device;

a body housing the mating connector; and a boom extending from the body, the boom comprising:

a first aperture through which light from the lamp may exit the boom;

a cover, rotatable around the boom and having a second aperture, such that the cover blocks the first aperture when the cover is in a first rotation position and aligns the second aperture with the first aperture when the cover is in a second rotation position; and a switch, electrically coupled to the lamp and mechanically coupled to the cover, such that rotating the cover between the first and second rotation positions activates the switch to turn the lamp on when the cover is in the second rotation position and off when the cover is in the first rotation position.

2. The device of claim 1, further comprising:

a power conductor and a ground conductor coupling power and ground terminals of the lamp to third and fourth terminals in the mating connector.

3. The device of claim 1, further comprising:

a battery compartment having positive and negative terminals for coupling to a battery, and a power conductor and a ground conductor coupling power and ground terminals of the lamp to the positive and negative terminals of the battery compartment.

4. The device of claim 3, further comprising:

a second power conductor and a second ground conductor coupling the power and ground terminals of the lamp to third and fourth terminals in the mating connector.

5. A device for coupling to a connector on an ear cup of a headset, the device comprising:

a mating connector corresponding to the connector of the headset, the mating connector including a crossover conductor coupled to a first and a second terminal within the mating connector;

a portable power supply coupled to a third and a fourth terminal within the mating conductor;

a lamp configured to direct light onto a surface external to the device;

a body housing the mating connector; and a boom extending from the body, the boom comprising:

a first aperture through which light from the lamp may exit the boom;

a cover, rotatable around the boom and having a second aperture, such that the cover blocks the first aperture when the cover is in a first rotation position and aligns the second aperture with the first aperture when the cover is in a second rotation position; and a switch, electrically coupled to the lamp and mechanically coupled to the cover, such that rotating the cover between the first and second rotation positions activates the switch to turn the lamp on when the cover is in the second rotation position and off when the cover is in the first rotation position.

* * * * *